US005538298A

United States Patent [19]

Ikeda

[11] Patent Number: 5,538,298

[45] Date of Patent: Jul. 23, 1996

[54] ACTUATOR WITH AN ANTI-THEFT MECHANISM FOR VEHICLE DOOR LOCKS

[75] Inventor: Takao Ikeda, Utsunomiya, Japan

[73] Assignee: Mitsui Kinzoku Kogyo, Tokyo, Japan

[21] Appl. No.: 341,116

[22] Filed: Nov. 18, 1994

[30] Foreign Application Priority Data

Nov. 30, 1993 [JP] Japan ..... 5-326300
Feb. 22, 1994 [JP] Japan ..... 6-047684

[51] Int. Cl.[6] ..... E05C 3/06

[52] U.S. Cl. ..... 292/201; 292/DIG. 23; 292/DIG. 27

[58] Field of Search ..... 292/201, DIG. 27, 292/DIG. 23, 336.3

[56] References Cited

U.S. PATENT DOCUMENTS 4,364,249 12/1982 Kleefeldt ..... 292/DIG. 23 X
4,904,006 2/1990 Hayakawa et al. ..... 292/DIG. 27 X
4,932,277 6/1990 Beaux ..... 292/201 X
4,934,746 6/1990 Yamada ..... 292/201
4,978,154 12/1990 Kleefeldt et al. .
5,066,054 11/1991 Ingenhoven ..... 292/201
5,154,457 10/1992 Watanabe ..... 292/201 X
5,438,855 8/1995 Ikeda ..... 292/DIG. 27 X

*Primary Examiner*—Rodney M. Lindsey
*Attorney, Agent, or Firm*—Browdy and Neimark

[57] ABSTRACT

An actuator for use with a vehicle door lock comprises an output member rotated by the motor, a first lever changed between locked and unlocked positions by the rotation of the output member and a key cylinder, a second lever connected to an inside locking button, an anti-theft member having an anti-theft position where the unlocking action of the second lever is not transmitted to the first lever and to the anti-theft cancelled position where the second lever and first lever are connected to each other, a changing member for changing the position of anti-theft member in response to the rotation of the output member; and a cancelling lever for causing the anti-theft member to be returned to the cancelled position by rotation of the output member without moving the first lever.

5 Claims, 11 Drawing Sheets

ACTUATOR WITH AN ANTI-THEFT MECHANISM FOR VEHICLE DOOR LOCKS

FIELD OF THE INVENTION

The present invention relates to an actuator with an anti-theft mechanism for a vehicle door lock.

BACKGROUND OF THE INVENTION

A conventional lock device for vehicle doors has a lock lever which can be moved between the locked and unlocked positions by means of the key cylinder, the inside locking button or the actuator. It is possible to change the known lock lever to the unlocked position by gripping the locking button with a gripping tool inserted into the clearance between the door and the vehicle body.

As shown in FIG. 21, U.S. Pat. No. 4,978,154 describes a lock device equipped with an anti-theft mechanism which can make such unjust operation as mentioned above impossible. The prior art lock device comprises a first lever A connected to the lock lever (not illustrated) and supported by a shaft B, a second lever C connected to the inside locking button D of the door and supported by the shaft B, an anti-theft member G movable in the left and right direction relative to the shaft B and rotatable integrally with the second lever C, said anti-theft member G having a projection F engaged with a forked portion E of the first lever A, and a changing member K having a slot H with which the projection F is engaged. Under the locked condition as shown in FIG. 21, when an inside nut M is caused to move left by a motor L, the changing member K begins to rotate to cause the anti-theft member G to move left, whereby the engagement between the projection F and the forked portion E is cancelled, and the anti-theft condition is produced. In the anti-theft condition, it is impossible to turn the first lever A to the unlocked position even though the anti-theft member G is turned clockwise by the locking button D.

The above prior art lock device has two major disadvantages. Firstly, there is doubt about the reliability of cancelling the anti-theft condition by a key cylinder. In cases where the lock lever is changed to the unlocked position by the key cylinder, the first lever A is displaced to the unlocked position in line therewith, then a slider N engaged with the first lever A moves right. However, as the inside nut M, which is in the anti-theft position, is not caused to move right even though the slider N moves right, the anti-theft member G is left at the anti-theft position. For this reason, it is understood that the prior art lock device is arranged so that the nut M is caused to move right by revolutions of the motor L when the lock lever is changed to the unlocked position by the key cylinder. However, in this case, if the battery power is completely consumed or the motor L malfunctions, an unexpected problem occurs.

The second disadvantage is that the first lever A is automatically changed to the unlocked position if the anti-theft conditon is cancelled by the motor L. In other words, it is impossible to cancel only the anti-theft conditon with the locked conditon maintained. Where public peace and order are not secured, if other doors are also unlocked when the driver's door is unlocked, a ruffian may get into a vehicle.

SUMMARY OF THE INVENTION

It is therefore one object of the invention to provide means to permit the anti-theft member to be returned to the cancelling position with manual operation by changing the first or locking lever to the unlocked position.

It is another object of the invention to provide means that can cancel only the anti-theft conditon with the locked condition secured.

Other features and advantages of the invention will be apparent from the detailed description of the preferred embodiments found below with reference to the accompanying drawings described hereafter.

DETAILED DESCRIPTION OF THE PREFERRED EMBODIMENTS

Figure 1:
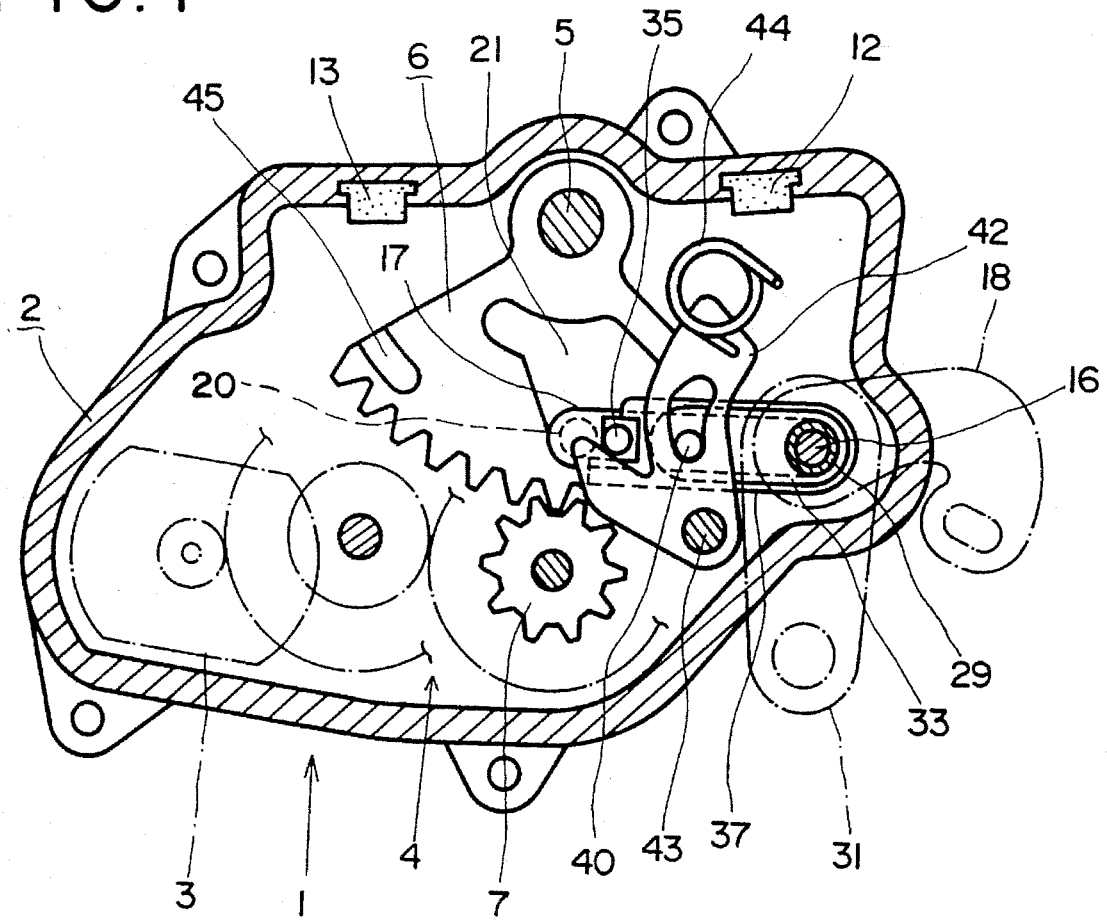
FIG. 1 is a cross-sectional view of an actuator according to the present invention.
Figure 3:
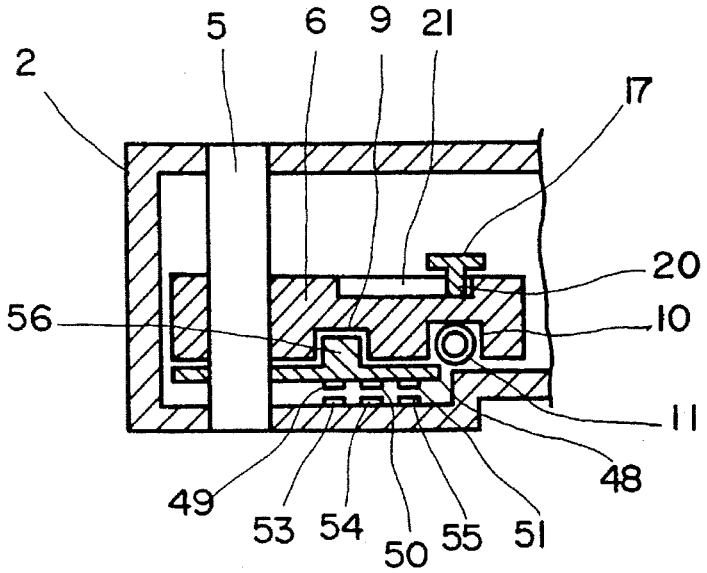
FIG. 3 is a cross-sectional view of the actuator with some parts thereof cut away.
Figure 5:
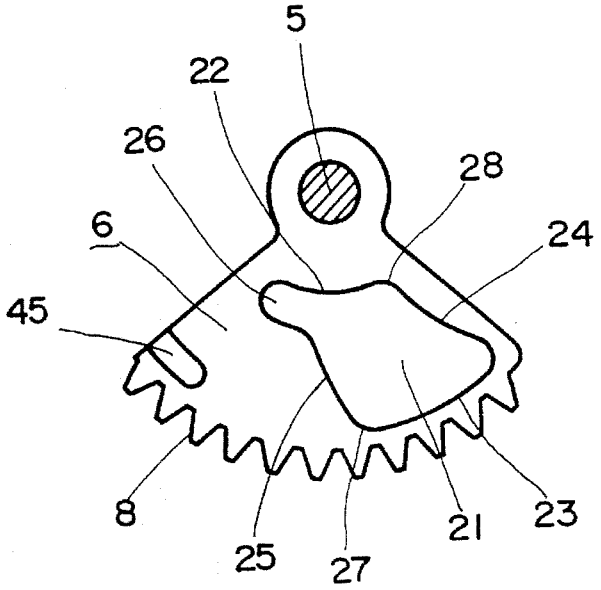
FIG. 5 is a plan view of an output member.
Figure 6:
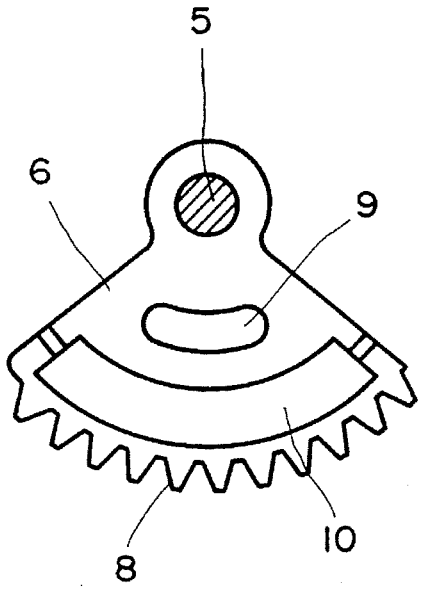
FIG. 6 is a bottom view of the output member.
Figure 8:
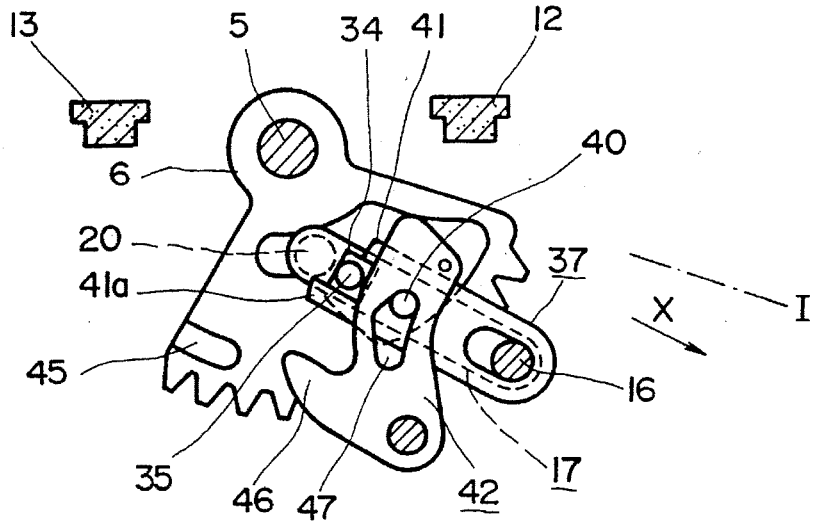
FIG. 8 is an explanatory view showing the state where the output member is turned from the state shown in FIG. 7 to the locking point I.
Figure 9:
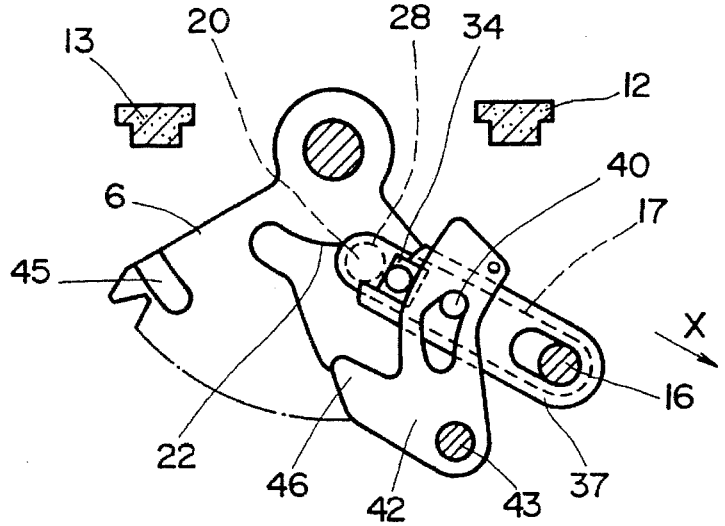
FIG. 9 is an explanatory view showing the locked condition.
Figure 10:
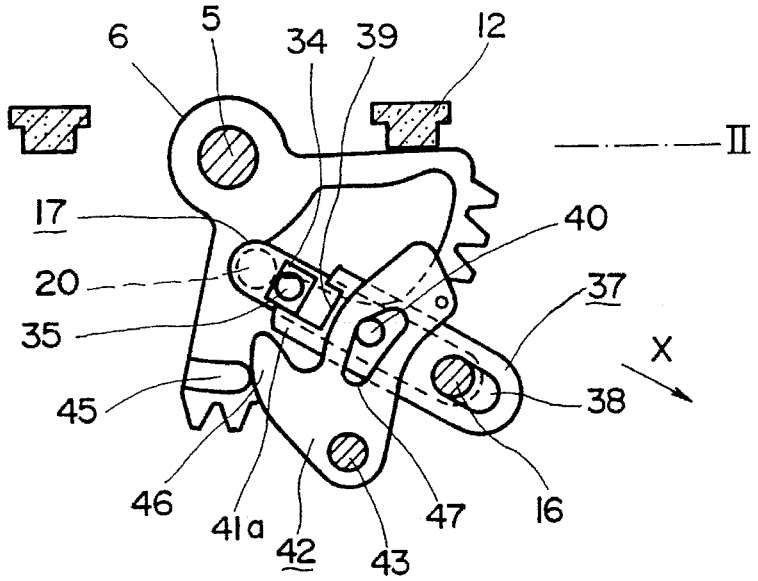
FIG. 10 is an explanatory view showing the state where the output member is turned from the state shown in FIG. 8 to the anti-theft point II.

Referring to FIGS. 1 to 12 which show a first preferred embodiment of the present invention, an actuator unit 1 has a housing 2 in which a motor 3 and reduction gears 4 are accommodated. A sector-shaped output member 6 which is supported at the housing 2 by an shaft 5 has at its outer circumferential edge a gear portion 8 engaged with the final gear 7 of the reduction gears 4. As shown in FIGS. 3 and 6, two arcuate grooves 9 and 10 are formed on the underside of the output member 6, centering around the shaft 5. A neutral returning spring 11 is accommodated in the outer groove 10. When the motor 3 does not rotate and no current flows to the motor, the output member 6 is maintained at the neutral position shown in FIGS. 1, 2 and 7 by the elasticity of the spring 11. But when the motor 3 rotates normally, the output member 6 is turned counterclockwise from the neutral position to an anti-theft point II in contact with a stopper 12 via a locking point I against the elasticity of the spring 11 (as shown in FIG. 10). On the contrary, when the motor 3 rotates reversely, the output member 6 is turned clockwise from the neutral position to an unlocking point III in contact with another stopper 13. As shown FIG. 2, projections 14 and 15 with which the ends of the spring 11 are brought into contact are formed at the housing 2.

A first lever 17 is arranged in the vicinity of the output member 6 and has at its one end a first shaft 16 which protrudes outwards, passing through the housing 2. A lock lever 18 which is changed between the locked and unlocked positions is rigidly connected to the projected portion of the first shaft 16 so that the lock lever 18 and first lever 17 rotate integrally with each other. A door key cylinder 19 is connected to the lock lever 18.

A pin 20 is formed at the other end of reverse side of the first lever 17 and is engaged with a cam groove 21 formed on the upper surface of the output member 6. As the output member 6 is turned from the neutral position, the pin 20 is pushed by the circumferential wall of the cam groove 21 to cause the first lever 17 to rotate centering around the first shaft 16.

Figure 7:
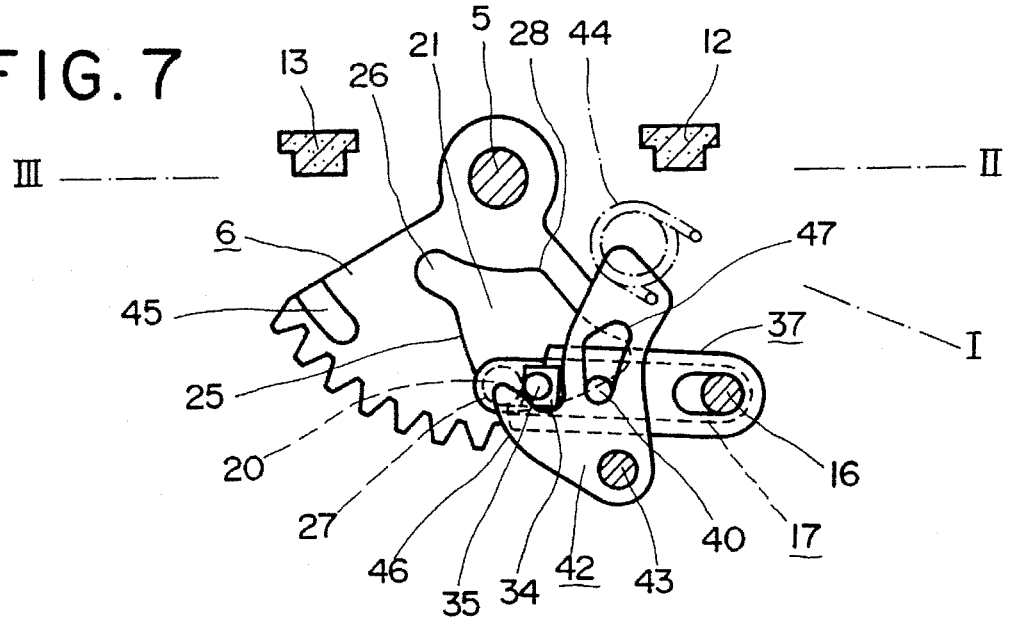
FIG. 7 is an explanatory view showing the unlocked condition.

The relationship between the cam groove 21 and first lever 17 will be described in detail. As shown in FIG. 5, the cam groove 21 is substantially composed of a pair of arcuate inner and outer walls 22 and 23 centering around the shaft 5 and a pair of unlocking and locking cam walls 24 and 25. A groove 26 centering around the shaft 5 is provided at the intersection between the inner wall 22 and cam wall 25. When the lock lever 18 is at the unlocked position and the output member 6 is at the neutral position, the pin 20 of the first lever 17 which is interlocked with the lock lever 18 is located at a first corner 27 formed between the outer wall 23 and locking cam wall 25, as shown in FIG. 7. In the state shown in FIG. 7, in a case where the output member 6 is turned counterclockwise to the locking point I by the motor 3, the locking cam wall 25 is engaged with the pin 20 to cause the first lever 17 to be turned clockwise and to be located at the locked position shown in FIG. 8, and also the lock lever 18 is changed to the locked position. Even though the output member 6 is turned counterclockwise to the anti-theft point II beyond the locking point I, the pin 20 only gets into the groove 26, and the first lever 17 does not rotate anymore.

In a case where electric current to the motor 3 is interrupted with the lock lever 18 moved to the locked position, the output member 6 is returned to the neutral position by the elasticity of the spring 11 as shown in FIG. 9, and the pin 20 is located at a second corner 28 formed between the unlocking cam wall 24 and inner wall 22. In a case where the output member 6 is turned clockwise in the state shown in FIG. 9, the unlocking cam wall 24 pushes the pin 20 to cause the first lever 17 to be turned counterclockwise. Therefore, it is possible for the lock lever 18 to be returned to the unlocked position.

Figure 4:
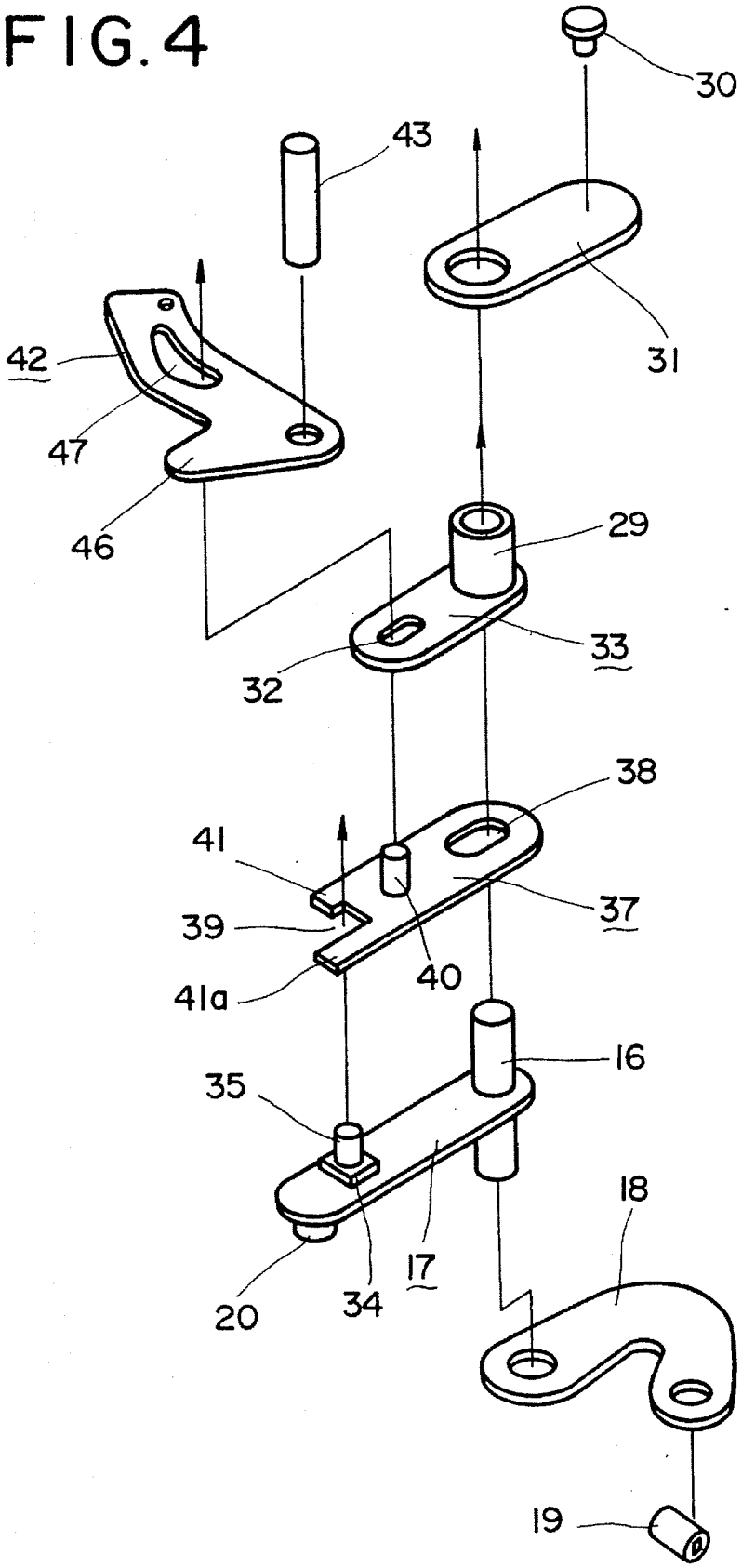
FIG. 4 is a disassembled perspective view of a group of levers.

As shown in FIGS. 4, a second lever 33 is provided above the first lever 17. The second lever 33 has at its one end a hollow second shaft 29 into which the first shaft 16 is rotatably inserted. The second lever 33 has a slot 32 at its other end. One end of the second shaft 29 protrudes outwards, passing through the housing 2. An intermediate lever 31 connected to the inside lock button 30 of the door is fixed at the protruded end of the second shaft 29 so that the locking button 30 and second lever 33 rotate integrally.

A box-like member 34 and pin-like member 35 are formed at the tip end of the upper surface of the first lever 17. An anti-theft member 37 is provided between the first and second levers 17 and 33 and has a slot 38 into which the first shaft 16 is inserted, a forked portion 39 with which the box-like member 34 is engaged, and a pin 40 with which the slot 32 of the second lever 33 is engaged. The anti-theft member 37 and second lever 33 integrally rotate by engagement of the slot 32 with the pin 40, whereas, in FIGS. 7 to 12, the drawings are simplified by omitting the second lever 33.

Figure 12:
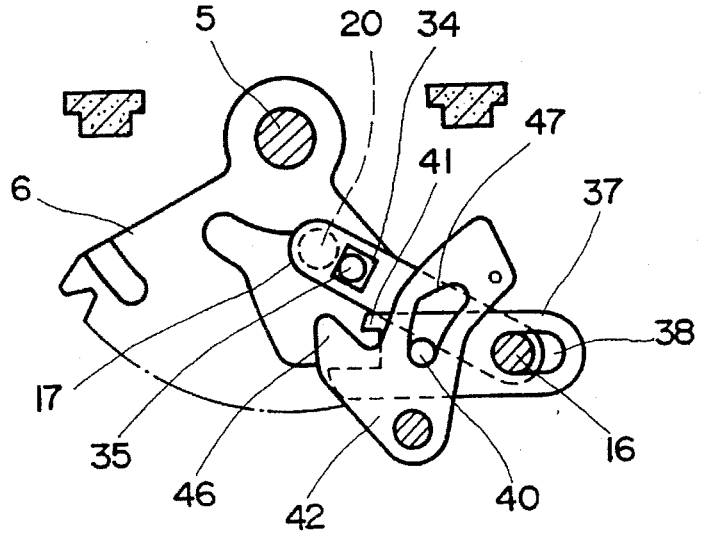
FIG. 12 is an explanatory view showing the anti-theft actions.

In the state Where the forked engaging member 39 is engaged with the member 34, the second lever 33 and first lever 17 are maintained in a mutually connected state. This means that the lock lever 18 and locking button 30 are connected to each other. However, in a case where the anti-theft member 37 is caused to slide in the direction of the arrow X as shown in FIG. 10, the engagement of a shorter leg 41 of the engaging portion 39 with the box member 34 is cancelled, then the anti-theft condition is produced. In this anti-theft condition, even though the anti-theft member 37 is caused to rotate counterclockwise by the unlocking operation of the locking button 30, it is impossible to cause the first lever 17 or the lock lever 18 to rotate in the unlocking direction, as shown in FIG. 12.

Figure 11:
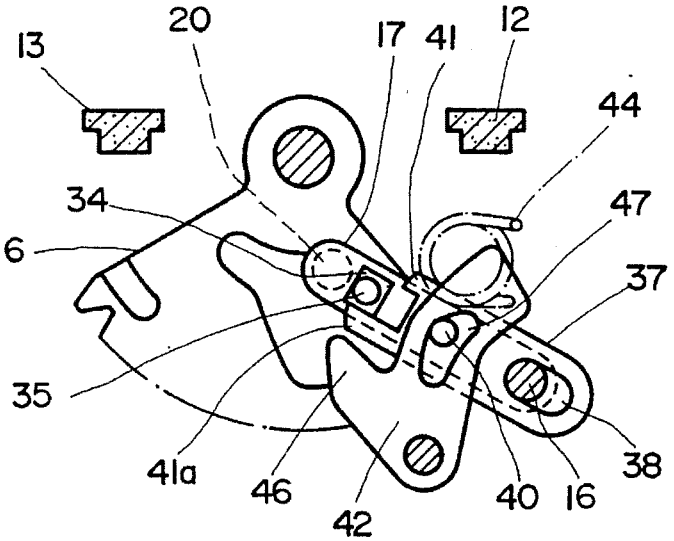
FIG. 11 is an explanatory view showing the anti-theft condition.

A changing member 42 is rotatably supported at the housing 2 by a shaft 43, and is maintained at either of the non-operating position shown in FIGS. 7 and 8 or the operating position shown in FIGS. 10 and 11 by an over-center spring 44. When the output member 6 is turned from the locking point I shown in FIG. 8 to the anti-theft point II shown in FIG. 10, the changing member 42 is changed from the non-operating position to the operating position by a projection 45 of the output member 6 being brought into contact with a hook-like contacting portion 46 of the member 42. The changing member 42 has an opening 47 into which a pin 40 of the anti-theft member 37 is inserted. The arrangement is such that, when the changing member 42 is changed to the operating position, the anti-theft member 37 slides in the direction of the arrow X to cause the anti-theft condition to be secured.

In the state shown in FIG. 10, when electric current to the motor 3 is interrupted, the output member 6 is returned to the neutral position by the elasticity of the spring 11 as shown in FIG. 11.

The changing member 42 located at the operating position as shown in FIG. 11 is returned to the non-operating position by the pin-like member 35 of the first lever 17 being engaged with the contacting portion 46 when the first lever 17 is turned counterclockwise by the output member 6 or the key cylinder 19, then the anti-theft member 37 moves in the counter direction of the arrow X to cause the anti-theft condition to be cancelled. Therefore, in the first preferred embodiment, when the anti-theft state is cancelled, the locking lever 18 is simultaneously returned to the unlocking position.

Figure 2:
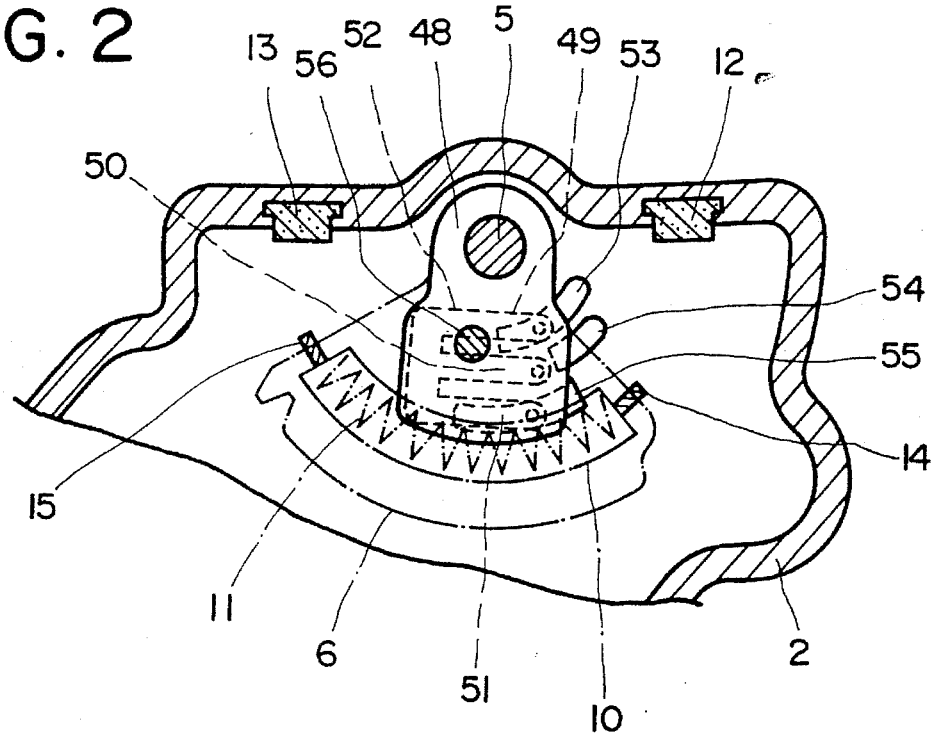
FIG. 2 is a cross-sectional view showing the relationship between a brush member and a conductive plate.

As shown in FIG. 2 and FIG. 3, a switch arm 48 is rotatably supported by the shaft 5 below the output member 6. An E-shaped brush member 52 having three brushes 49, 50 and 51 is provided on the reverse side of the switch arm 48. Three independent conductive plates 53, 54 and 55 which correspond to the brushes 49, 50 and 51 respectively are provided on the bottom of the housing 2. A projection 56 which is engaged with the arcuate groove 9 of the output member 6 with a lost-motion is provided on the upper surface of the switch arm 48. The brushes and conductive plates are secured in a circuit which connects the motor 3 with a battery of the vehicle.

A description will be given of the actions of the first preferred embodiment.

In the case of changing the lock lever 18 to the locked position by the motor 3, a positive current is supplied to the conductive plate 55. In this case, the electric current flows to the conductive plate 53 via the brush member 52 and is fed to the motor 3 as a positive electric current, then the output member 6 is turned from the neutral position shown in FIG. 7 to the locking point I shown in FIG. 8. When the output member 6 is turned to the locking point I, the pin 20 of the first lever 17 is pushed by the locking cam wall 25 and the first lever 17 is displaced to the locked position, and the lock lever 18 connected to the first lever 17 by the first shaft 16 is also displaced to the locked position. Further, when the first lever 17 is displaced to the locked position, the anti-theft member 37 is turned clockwise by engagement of the box-like member 34 with the forked portion 39 to cause the anti-theft member 37 to be turned clockwise, then the locking button 30 is changed to the locked position via the second lever 33 and intermediate lever 31. Furthermore, when the output member 6 reaches the locking point I, the brush member 52 is parted from the conductive plate 55 and the electric current to the conductive plate 55 is then interrupted.

In the case of changing the anti-theft member 37 to the anti-theft position by the motor 3, a positive current is supplied to the conductive plates 55 and 54. In this case, the electric current firstly flows to the conductive plate 53 via the brush member 52 and is fed to the motor 3 as a positive electric current, then the output member 6 is turned from the neutral position shown in FIG. 7 to the locking point I shown in FIG. 8. When the output member 6 is caused to reach the locking point I, the lock lever 18 and locking button 30 are, as described above, changed to the locked position, respectively, and the brush member 52 is parted from the conductive plate 55. However, before the brush member 52 is parted from the conductive member 55, the brush member 52 is brought into contact with another conductive plate 54. Therefore, the motor 3 is continuously rotated, and the output member 6 is turned to the anti-theft point II as shown in FIG. 10. In this state shown in FIG. 10, the changing member 42 is changed to the operating position from non-operating position by the hook 46 of the changing member 42 being pushed by the projection 45 of the output member 6, thereby causing the anti-theft member 37 to slide in the direction of the arrow X and the anti-theft condition to be secured. In this anti-theft condition, even though the anti-theft member 37 is turned counterclockwise by operating the locking button 30 for unlocking, the first lever 17 does not rotate due to the disengagement between the shorter leg 41 of the engaging portion 39 and the member 34 as shown FIG. 12. Therefore, it will be unable to unlock the lock lever 18 by the unlocking operation of the locking button 30.

In the case of cancelling the anti-theft condition by the motor 3, electric current is supplied to the conductive plate 53. In this case, the electric current flows to the conductive plate 55 via the brush member 52 and is fed to the motor 3 as a negative electric current, then the output member 6 is turned clockwise from the neutral position shown in FIG. 11. So, the first lever 17 is displaced to the unlocked position by the pin 20 being pushed by the unlocking cam wall 24 and the lock lever 18 connected to the first lever 17 by the first shaft 16 is also displaced to the unlocked position. Furthermore, as the box-like member 34 is engaged with a longer leg portion 41*a* of the engaging portion 39, when the first lever 17 reaches the unlocked position the anti-theft member 37 is turned counterclockwise, thereby causing the locking button 30 to be changed to the unlocked position. Simultaneously, as the pin-like member 35 is brought into contact with the engaging portion 46 of the changing member 42, when the first lever 17 is turned counterclockwise the changing member 42 is also turned counterclockwise, thereby causing the anti-theft member 37 to slide in the counter direction of the arrow X and the anti-theft condition to be cancelled. Thus, according to one aspect of the present invention, returning to the unlocked position of the first lever 17 causes the anti-theft member 37 to return to the cancelled position, whereas if the first lever 17 is unlocked by the key cylinder 19, it is possible to manually cancel the anti-theft condition without fail.

A second preferred embodiment of the invention will be described with reference to FIGS. 13 to 20. The second preferred embodiment is such that only the anti-theft condition can be cancelled without cancelling the locked condition by modifying the first embodiment without changing the generic concept.

Figure 13:
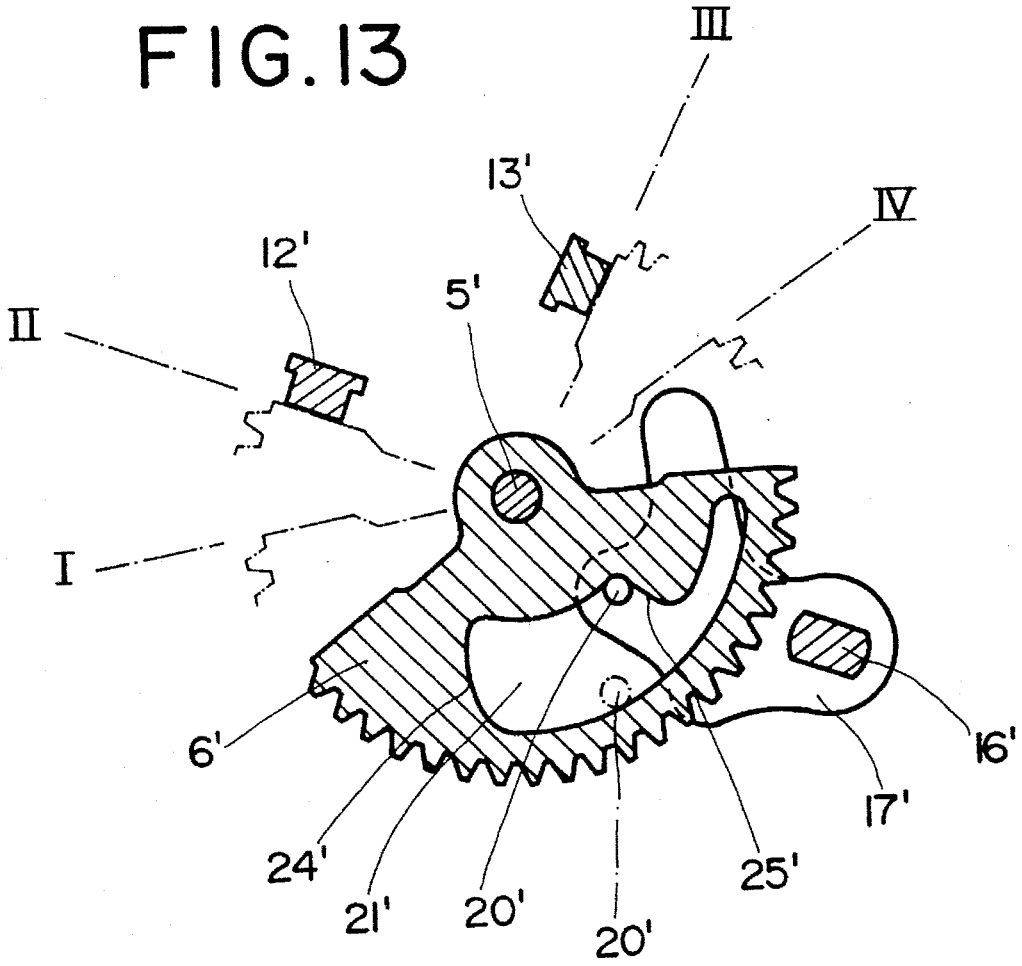
FIG. 13 is an explanatory view showing the relationship between an output member according to a second preferred embodiment of the invention and a first lever.

As shown in FIG. 13, in the case where the output member 6' of the second preferred embodiment is turned clockwise by the rotation of the motor, the output member 6' is displaced from the neutral position to the anti-theft point II, which comes in contact with a stopper 12', via the locking point I. And in the case where it is turned counterclockwise, the output member 6' is displaced to the unlocking point III, which comes in contact with the stopper 13', via the anti-theft cancelling point IV.

The first lever 17' shown in FIG. 13 is located at the unlocked position, and when the output member 6' is turned clockwise to the locking point I by motor, the locking cam wall 25' engages with the pin 20' to cause the first lever 17' to be turned counterclockwise and to cause the pin 20' to be displaced to the locked position shown with a hypothetical line. Here, it is important that the pin 20' at the locked position is parted from the unlocking cam wall 24' of the output member 6' positioned in the neutral. As such a distance is provided, it is possible for the output member 6' to be turned from the neutral position to the anti-theft cancelling point IV with the first lever 17' maintained at the locked position as described below.

Figure 14:
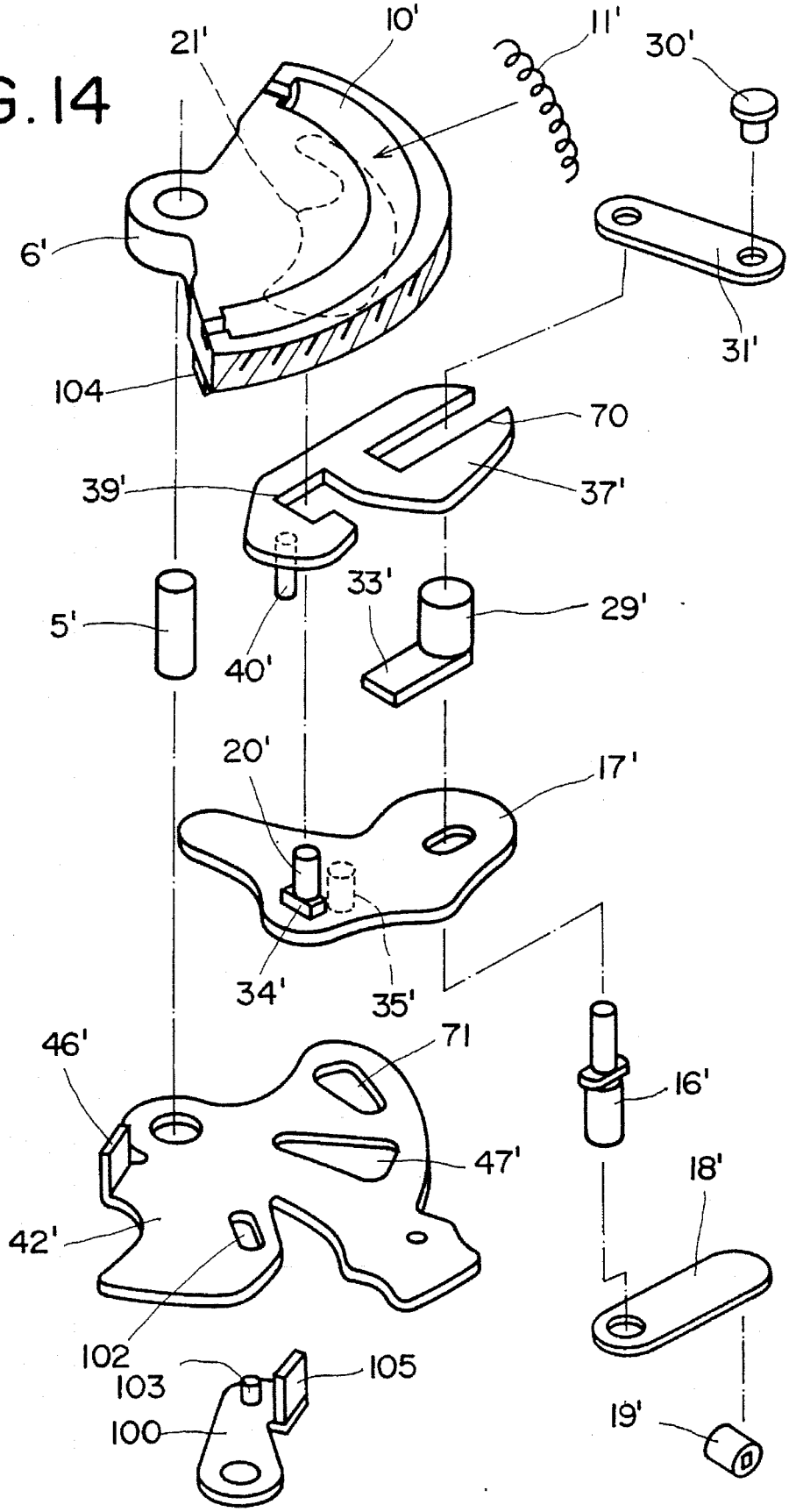
FIG. 14 is a disassembled perspective view of a groups of levers of the second preferred embodiment.
Figure 15:
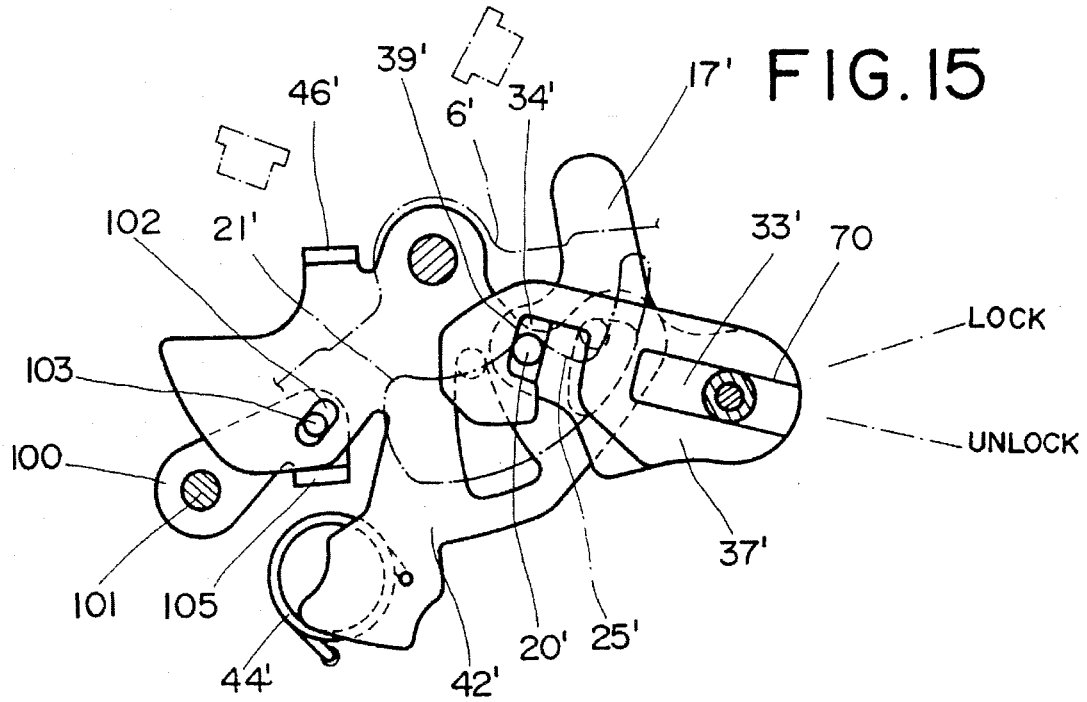
FIG. 15 is an explanatory view showing the unlocked condition of the second preferred embodiment.
Figure 16:
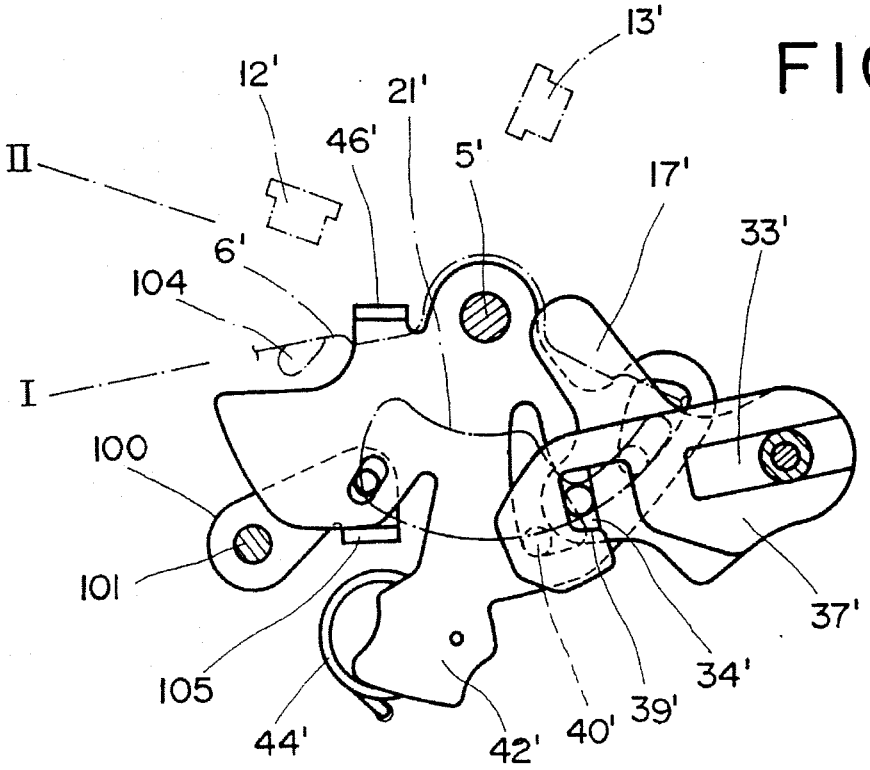
FIG. 16 is an explanatory view showing the state where the output member is turned from the state shown in FIG. 15 to the locking point I.
Figure 17:
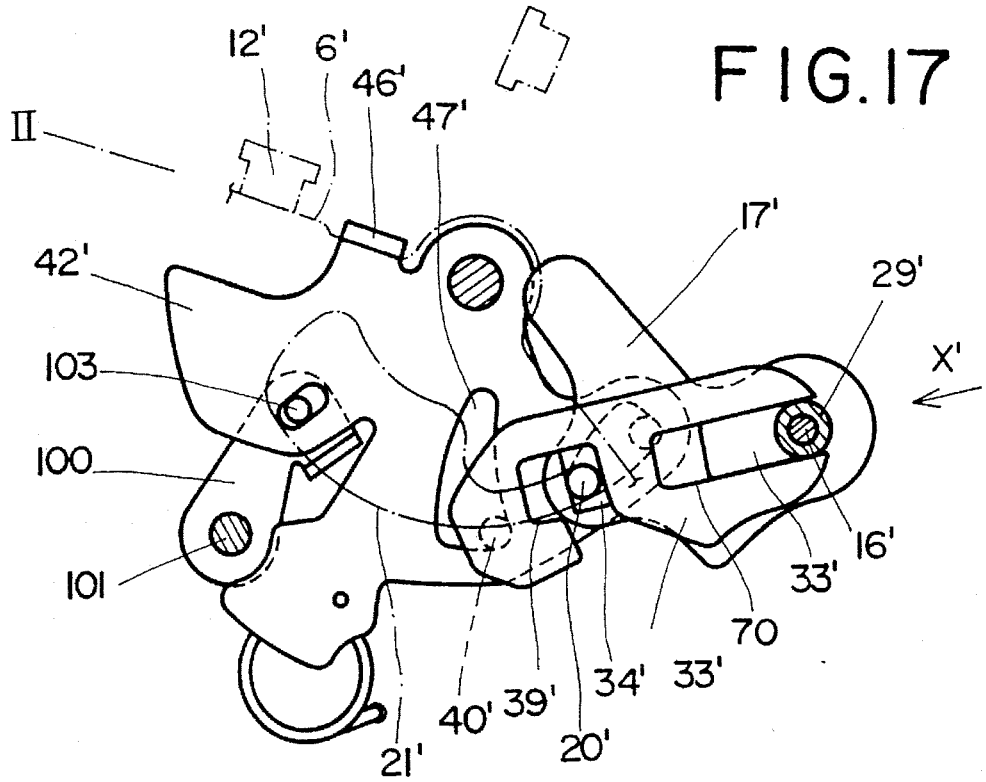
FIG. 17 is an explanatory view showing the state where the output member is turned from the state shown in FIG. 16 to the anti-theft point II.

As shown in FIG. 14, the second lever 33' has the hollow second shaft 29' into which the first shaft 16' is rotatably inserted. The locking button 30' is connected to the second shaft 29' via the intermediate lever 31'. The anti-theft member 37' has a slit 70 slidably engaged with the second lever 33' and a hook-like engaging portion 39' which is engaged with the box-like member 34' of the first lever 17'. As shown in FIG. 15, in the state where the member 34' is engaged with the engaging portion 39', the locking button 30' and lock lever 18' will enter a mutually connected condition or anti-theft cancelled condition. However, as shown in FIG. 17, in a case where the anti-theft member 37' is caused to slide in the direction of the arrow X, the engagement of the member 34' with the engaging portion 39' is cancelled (anti-theft condition), and even though the anti-theft member 37' is turned clockwise by the unlocking operation of the locking button 30', the first lever 17' does not rotate. Therefore, it is impossible to displace the lock lever 18' to the unlocked position under the anti-theft condition.

The pin 20' is formed integrally at the upper part of the member 34'. This is the point which is different from the first embodiment. However, the difference is only a modification of the arrangement. A member 35' corresponding to the member 35 of the first embodiment is formed on the reverse side of the first lever 17'.

The changing member 42' of the second embodiment is supported by the shaft 5'. The changing member 42' has an opening 47' with which the pin 40' of the anti-theft member 37' is engaged. The changing member 42' is displaced from the non-operating position shown in FIGS. 15 and 16 to the operating position in FIG. 17 by the engaging portion 46' being brought into contact with the edge of the output member 6' when the output member 6' is turned clockwise from the position in FIG. 16, thereby causing the anti-theft member 37' to slide in the direction of the arrow X and to enter the anti-theft position.

Figure 18:
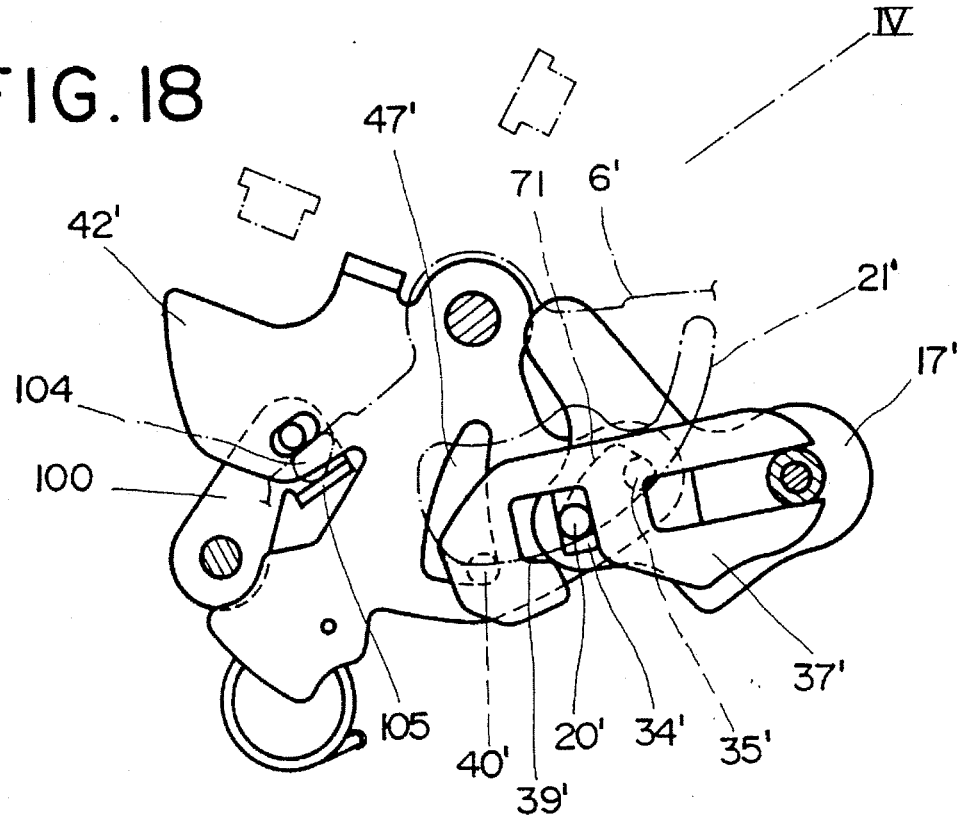
FIG. 18 is an explanatory view showing the anti-theft condition of the second preferred embodiment.
Figure 19:
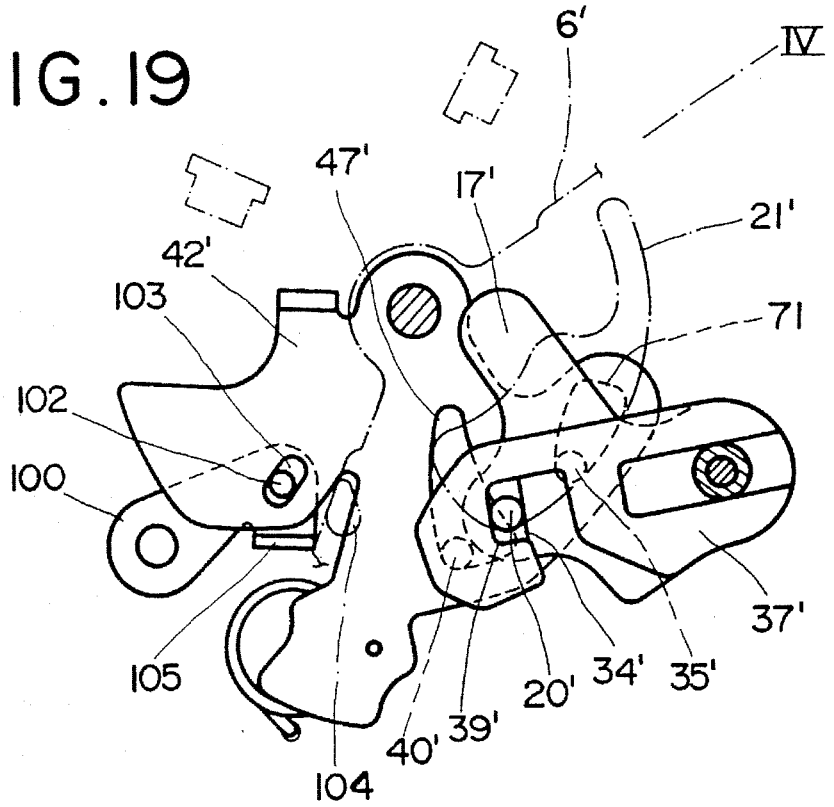
FIG. 19 is an explanatory view showing the state where the output member is turned from the state shown in FIG. 18 to the anti-theft cancelling point IV.
Figure 20:
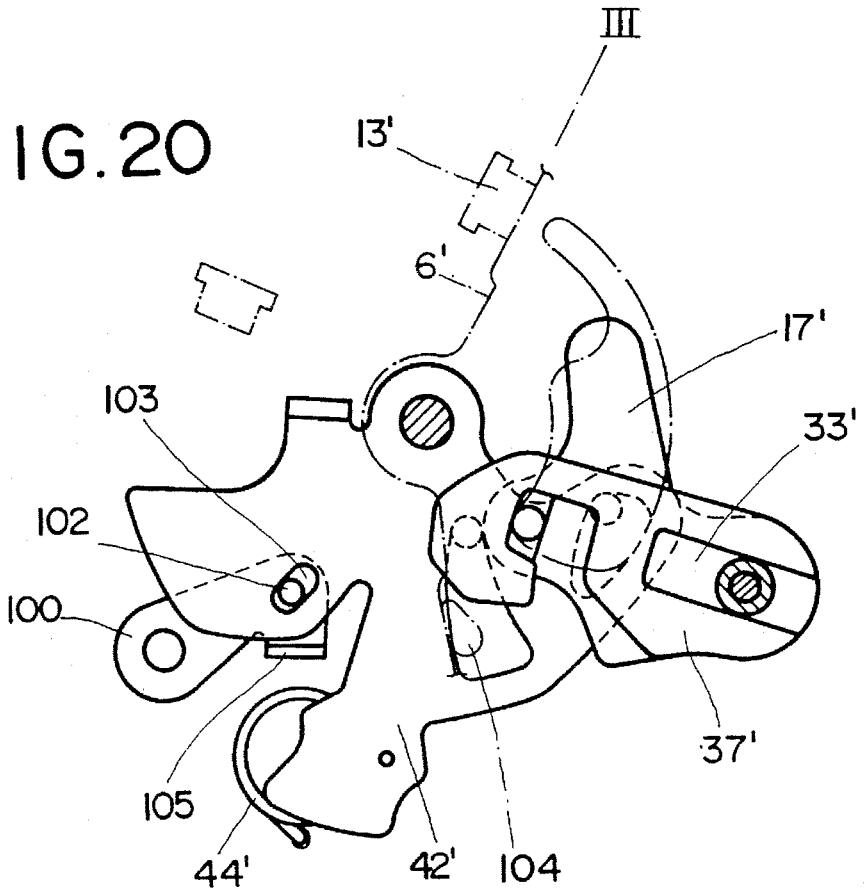
FIG. 20 is an explanatory view showing the state where the output member is turned from the state shown in FIG. 19 to the unlocking point III.
Figure 21:
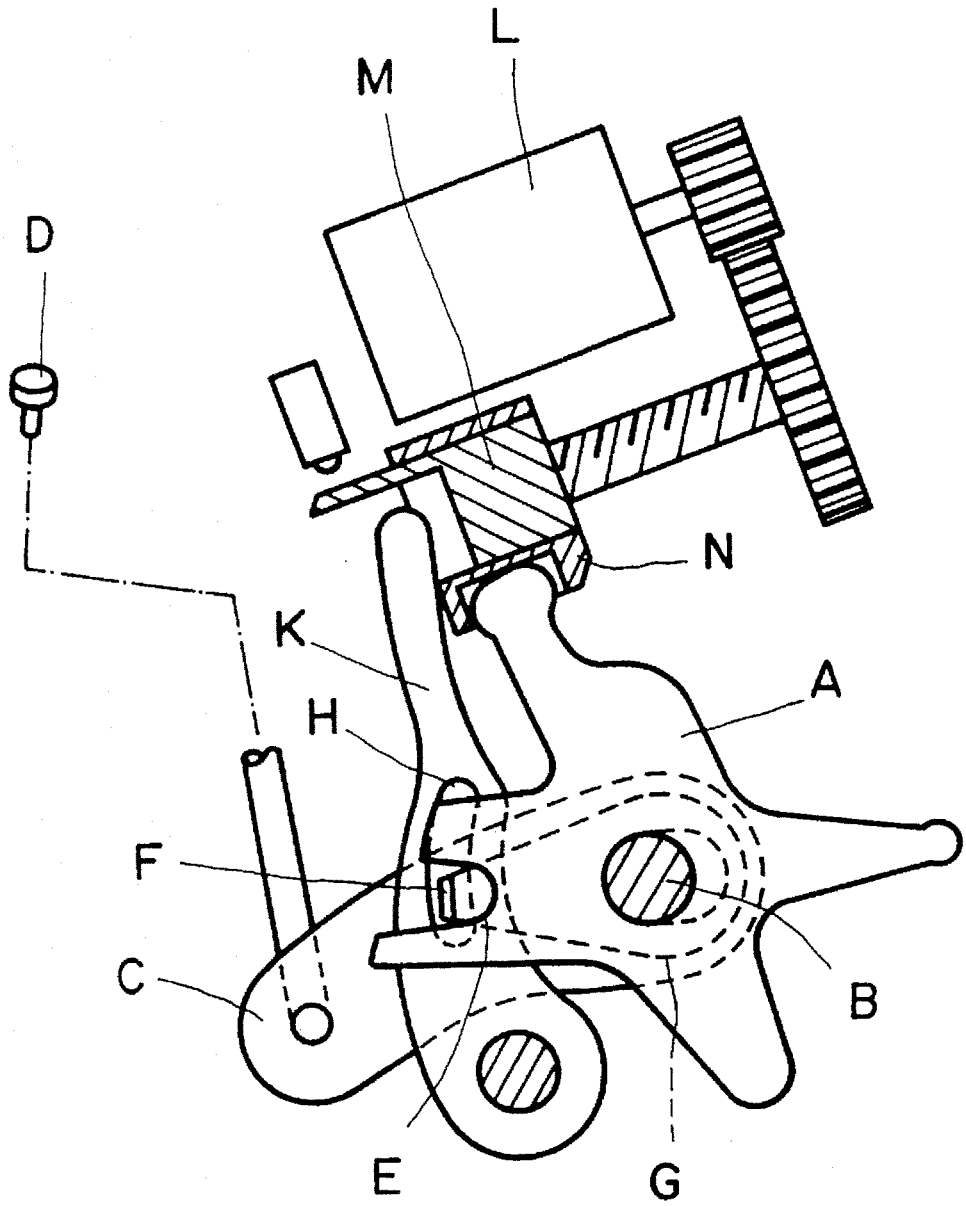
FIG. 21 (PRIOR ART)
FIG. 21 is a view showing a prior art lock device.

The actuator unit of the second embodiment further has a cancellation lever 100 which causes the changing member 42' to be returned from the operating position to the non-operating position. The cancellation lever 100 is rotatably supported by a shaft 101, and has a projection 103 engageable with a slot 102 formed at the changing member 42' and an engaging piece 105 engageable with a drop-like projection 104 formed at the reverse side of the output member 6'. As shown in FIG. 18, the engaging piece 105 and projection 104 roughly face each other in such a state where the changing member 42 is located at the operating position and the output member 6' is maintained at the neutral position. In the case where the output member 6' is turned counterclockwise to the anti-theft cancelling point IV in the state shown in FIG. 18, the projection 104 is engaged with the engaging piece 105 to cause the cancellation lever 100 to be turned clockwise, centering around the shaft 101. Thereby the changing member 42' is turned counterclockwise centering around the shaft 5' by the engagement between the projection 103 and slot 102 of the lever 100 and is displaced from the operating position to the non-operating position. Therefore, the anti-theft member 37' slides in the counter direction of the arrow X and is returned to the cancelled position. Furthermore, as the unlocking cam wall 24' of the cam groove 21' is not engaged with the pin 20' of the first lever 17' even though the output member 6' is turned counterclockwise to the anti-theft cancelling point IV, the first lever 17' remains at the locked position.

As described above, in the second embodiment, it is possible to cancel only the anti-theft condition with the locked condition secured, by causing the output member 6' to be turned counterclockwise from the neutral position to the cancelling point IV. If an actuator unit according to the second preferred embodiment is used, it is possible to provide a lock device which cancels only the anti-theft condition with the locked condition maintained at other doors even though the driver's door is unlocked.

The changing member 42' has an engaging hole 71 with which the pin 35' of the first lever 17' is engaged. In a case where the first lever 17 is turned clockwise in the anti-theft condition state shown in FIG. 18, the pin 35' is engaged with the engaging hole 70 to cause the changing member 42' to be displaced from the operating position to the non-operating position. This means that, if the lock lever 18' (and first lever 17') is changed to the unlocked position by operating the key cylinder 19' for unlocking, the changing member 42 is changed from the operating position to the non-operating position in line therewith, and it is possible to simultaneously carry out a resetting of the anti-theft member 37' to the cancelling position.

What is claimed is:

1. An actuator for use with a vehicle door lock comprising:

a reversible motor;

an output member arranged to be rotated by the motor;

a first lever arranged to be changed between a locked and an unlocked position by rotation of the output member and a key cylinder of the door;

a second lever connected to an inside locking button of the door;

an anti-theft member arranged for movement between an anti-theft position where an unlocking action of the second lever is not transmitted to the first lever, and an anti-theft cancelled position where the second lever and first lever are connected to each other; and a changing member for changing each said position of the anti-theft member in response to the rotation of the output member, wherein the first lever is further so arranged that when the first lever is changed to the unlocked position by the key cylinder, the first lever is brought into contact with the changing member and causes the anti-theft member to be returned to the cancelled position, wherein the output member is biased towards a neutral position by the elasticity of a return spring.

2. An actuator set forth in claim 1, wherein the first lever is arranged to be displaced between the locked and the unlocked position by the key cylinder without moving the output member from the neutral position.

3. An actuator set forth in claim 1, wherein the actuator has a housing accommodating said motor, said output member, said first lever, said second lever, said anti-theft member and said changing member.

4. An actuator set forth in claim 3, wherein a first and a second shaft which support said first lever and said second lever respectively, protrude outward, passing through said housing.

5. An actuator set forth in claim 4, wherein said first shaft rotates coaxially within a hollow of said second shaft.

* * * * *